United States Patent [19]

Roy, Sr. et al.

[11] Patent Number: 4,989,485

[45] Date of Patent: Feb. 5, 1991

[54] TABLE SAW ACCESSORY

[76] Inventors: Robert W. Roy, Sr.; Robert W. Roy, Jr., both of 55 Blackstone St., Mendon, Mass. 01756

[21] Appl. No.: 476,854

[22] Filed: Feb. 8, 1990

[51] Int. Cl.[5] ..... B27B 25/10; B27B 27/08

[52] U.S. Cl. ..... 83/432; 83/435.1; 83/437; 83/477.2

[58] Field of Search ..... 83/432, 435.1, 437, 83/474, 418, 425, 446, 401, 423, 648, 477.2, 421, 468.1, 468.3, 467.1, 420, 419, 444; 269/304

[56] References Cited

U.S. PATENT DOCUMENTS

| | | | |
|---|---|---|---|
| 2,001,306 | 5/1935 | Gressner | 83/435.1 |
| 4,476,757 | 10/1984 | Morris | 83/446 |
| 4,741,387 | 5/1988 | Strong | 83/435.1 |

*Primary Examiner*—Hien H. Phan
*Assistant Examiner*—Kenneth E. Peterson
*Attorney, Agent, or Firm*—John E. Toupal; Harold G. Jarcho

[57] ABSTRACT

An accessory for use with a table saw having a generally horizontal surface defining at least one rectalinear groove and a circular saw blade projecting through the horizontal surface and parallel to the groove; the accessory including a plate having lower and upper surfaces with the lower surface adapted for sliding movement on the horizontal surface; a first rectalinear rail supported by the plate and projecting in an active position below the lower surface and adapted to ride in the groove and guide movement of the plate parallel to the groove and for movement into an inactive position above the lower surface; a second rectalinear rail supported by the plate and adapted for movement between an active position below the lower surface and an inactive position above the lower surface, the second rail in its active position adapted to ride in the groove and guide movement of the plate parallel to the groove and being perpendicular to the second guide surface and oriented at an angle of 45° to the first rail. The accessory simplifies procedures required to produce 45° cuts with the table saw.

20 Claims, 3 Drawing Sheets

TABLE SAW ACCESSORY

BACKGROUND OF THE INVENTION

This invention relates generally to an accessory for use on table or band type saws of the type in which a rotary saw blade extends upwardly out of a slot in a generally horizontal surface and, more particularly, to such an accessory for use in producing 45° and 90° angle cuts.

Table and band saws are quite commonly used by professional carpenters as well as by hobbyists. Typically, the saws are quite versatile since the saw blade can be inclined relative to the table surface and since the work may be inclined relative to the blade, cuts of many different angles can be made in the work. When using table and band saws, repetitive consistent cuts often are required in the work at an angle inclined to the long dimension of the work. The most common cut made, other than perpendicular to the long dimension of the work, is at a 45° angle. This type cut is made at every inside and outside corner on a wide variety of types of work, such as framing lumber, mill work, trim and the like. Consequently, various accessories have been proposed to assist in making these type cuts. Such accessories are included in the disclosures of U.S. Pat. Nos. 702,043; 2,881,812; 3,456,541; 3,808,923; 3,830,127; 3,880,032; 4,111,409; 4,123,955; 4,206,672; 4,367,668; 4,441,394; and 4,693,156.

The object of this invention is to provide an improved table saw accessory for use in producing 45° and 90° angle cuts.

SUMMARY OF THE INVENTION

The invention is an accessory for use with a table saw having a generally horizontal surface defining at least one rectalinear groove and a circular saw blade projecting through the horizontal surface and parallel to the groove; the accessory including a plate having lower and upper surfaces with the lower surface adapted for sliding movement on the horizontal surface; a first rectalinear rail supported by the plate and projecting in an active position below the lower surface and adapted to ride in the groove and guide movement of the plate parallel to the groove and for movement into an inactive position above the lower surface; a second rectalinear rail supported by the plate and adapted for movement between an active position below the lower surface and an inactive position above the lower surface, the second rail in its active position adapted to ride in the groove and guide movement of the plate parallel to the groove and being perpendicular to the second guide surface and oriented at an angle of 45° to the first rail. The accessory simplifies procedures required to produce 45° cuts with the table saw.

According to one feature of the invention, the accessory includes a first fence defining a first rectalinear guide surface oriented at an angle of 45° to the first rail; and a second fence defining a second rectalinear guide surface oriented at an angle of 45° to the first rail and perpendicular to the first fence.

According to another feature of the invention, the accessory includes a first actuator coupled to the first rail and operable to produce movement thereof between its active and inactive positions; and a second actuator coupled to the second rail and operable to produce movement thereof between its active and inactive positions. The first and second actuators facilitate use of the accessory.

According to further features of the invention, the accessory includes a third fence defining a third rectalinear guide surface oriented at an angle of 45° to the second rail; a first auxilliary fence defining a first auxilliary surface joining said first and second surfaces and oriented at angles of 45° with respect thereto and a second auxilliary fence defining a second auxilliary surface joining the third guide surface and the second guide surface and oriented perpendicular thereto, and wherein the first and second auxilliary surfaces straddle the first and second rails. These features enhance the functionality of the accessory.

According to yet other features of the invention, the plate and the first, second, third and auxilliary fences are formed as a composite unit, and the first and second rails comprise continuous tracks having rectangular cross-sections corresponding to the cross section of the groove. Mounting of the accessory is facilitated by these features.

In a preferred embodiment of the invention, the first actuator biases the first rail into one of its active or inactive positions and includes a first latch operable to latch the first rail in the other of its positions; and the second actuator biases the second rail into one of its active or inactive positions and includes a second latch operable to latch the second rail in the other of its positions. The latchable actuators simplify alternative use of the first and second rails.

The invention additionally includes an attachment adapted for attachment to the accessory and defining therewith an attachment guide surface extending parallel to one of the first or second guide surfaces and inclined at an angle of 45° thereto. When combined with the attachment, the accessory can be used to produce 45° compound angle cuts.

According to further features of the invention, the attachment comprises a plurality of brackets extending rearwardly from the attachment guide surface, each of the brackets has an attachment slot; and at least one of the first, second or third fences has a plurality of receiving slots each adapted to receive one of the attachment slots. The slots facilitate proper mounting of the attachment on the accessory.

DESCRIPTION OF THE DRAWINGS

These and other objects and features of the invention will become more apparent upon a perusal of the following description taken in conjuction with the accompanying drawings wherein.

DESCRIPTION OF THE PREFERRED EMBODIMENT

Figure 1:
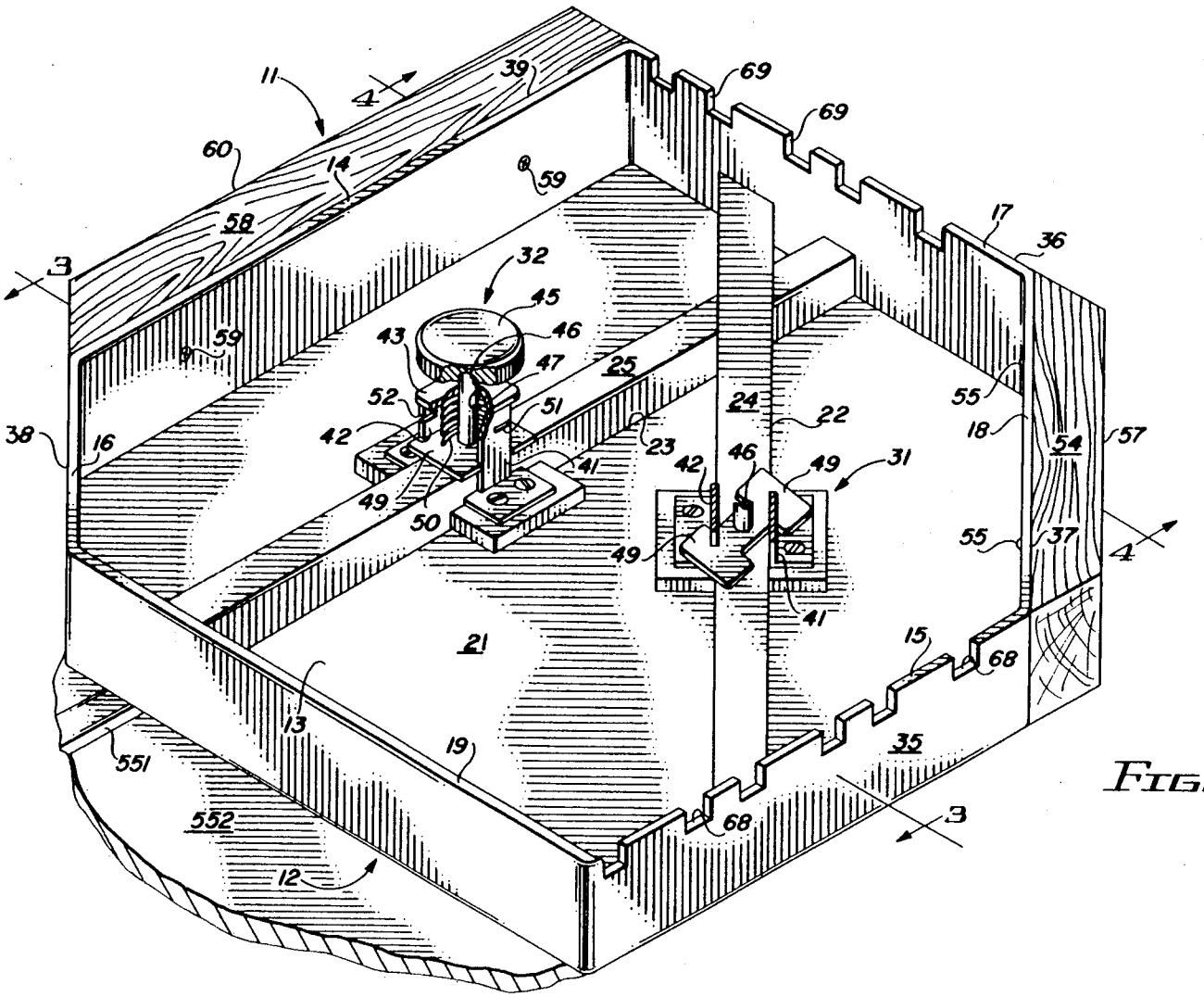
FIG. 1 is a perspective view of a table saw accessory according to the invention.

A table saw accessory 11 includes a unitary box 12 including a bottom plate 13 and sidewalls 14–19 extending perpendicularly from an upper surface 21 thereof. Formed in the plate 13 and intersecting at an angle of 45° are first and second slots 22, 23. Also included in the accessory 11 is a first elongated rail 24 of rectangular cross-section retained by the first slot 22 and mounted for transverse movement therein between an active position extending below a lower surface 27 of the plate 13 and an inactive position thereabove, and a second elongated rail 25 of rectangular cross-section and retained by the second slot 23 and mounted for transverse movement therein between an active position below the lower surface 27 and inactive position thereabove. Movement of the first and second rail tracks 24, 25, respectively, between active and inactive positions is controlled by first and second actuator mechanisms 31, 32.

The wall 15 provides a first fence defining a first guide surface 35 oriented at an angle of 45° with respect to the first rail 24. Similarly, the wall 17 provides a second fence defining a second guide surface 36 oriented at an angle of 45° with respect to the first rail 24. The first guide surface 35 extends perpendicularly to the second guide surface 36. Joining the first and second guide surfaces 35, 36 is the wall 18 that provides a first alignment surface 37 oriented at angles of 45° to both the surface 35 and 36. The wall 16 provides a third fence defining a third guide surface 38 oriented at an angle of 45° with respect to the second rail 25. Joining ends of the second and third guide surfaces 36, 38 is the wall 14 that provides a second alignment surface 39 oriented perpendicularly to the second guide surface 36 and at an angle of 45° to said third guide surface 38. Ends of the first guide surface 35 and the third guide surface 38 are joined by the wall 19.

The actuator 32 is most clearly shown in FIG. 1. A pair of perpendicular, spaced apart legs 41, 42 are mounted on the upper surface 21 of the plate 13 on opposite sides of the second rail 25. Extending between top ends of the legs 41, 42 is a horizontal plate 43. A knob 45 has a shaft 46 that extends slidably through a central aperture 47 in the plate 43 and has an outer end pivotally secured to the second rail 25. Also secured to the shaft 46 between the plate 43 and the rail 25 is a latch plate member 49. Formed near the upper ends of the legs 41, 42, respectively, are oppositely facing latching slots 51, 52. Seated between the latch plate 49 and the upper plate 43 is a bias spring member 50 that exerts a force biasing the second rail 25 in an active position that extends below the lower surface 27 of the plate 13. The actuator 31 partially shown in FIG. 1 is identical to the actuator 32.

Secured to the sidewall 18 by screws 55 is a spacer block 54 that provides a first auxilliary surface 57 parallel to the first alignment surface 37. Similarly secured to the sidewall 14 by screws 59 is a spacer block 58 that provides a second auxilliary surface 60 parallel to the second alignment surface 39.

Figure 3:
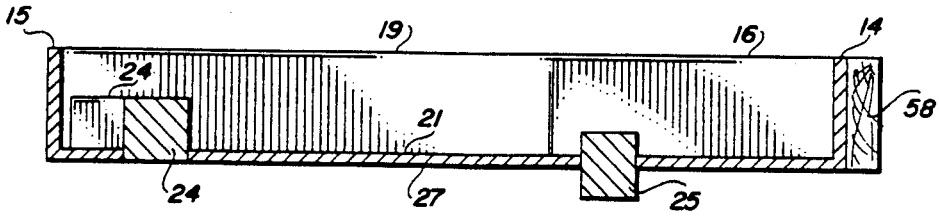
FIG. 3 is a cross-sectional view taken along lines 3—3 of FIG. 2.
Figure 4:
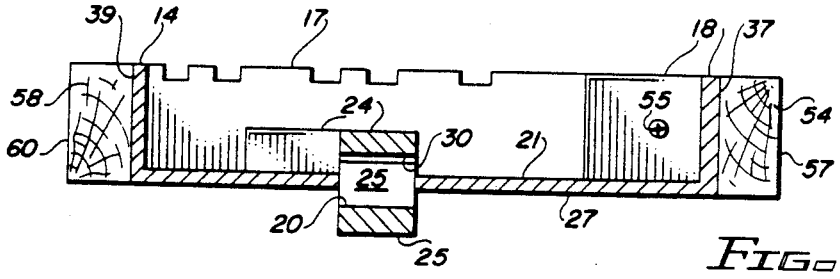
FIG. 4 is a cross-sectional view taken along lines 4—4 of FIG. 2.
Figure 5:
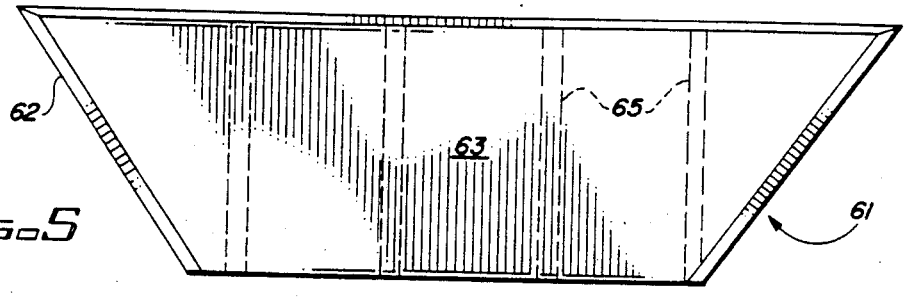
FIG. 5 is a front view of an attachment for use with the accessory of FIG. 1.
Figure 6:
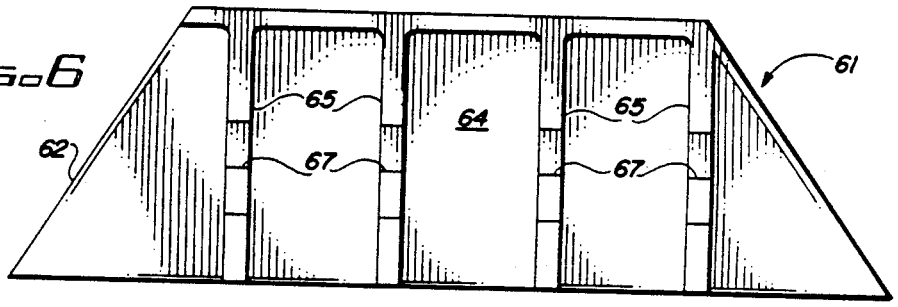
FIG. 6 is a rear view of the attachment shown in FIG. 5.
Figure 7:
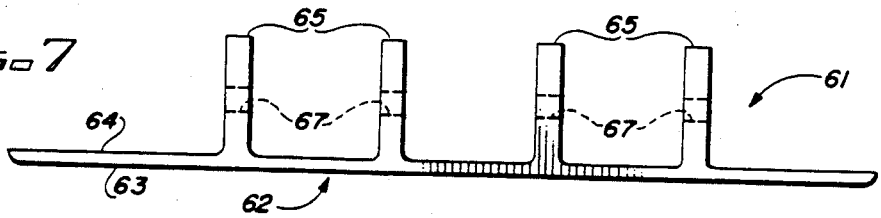
FIG. 7 is a side view of the attachment shown in FIG. 5.
Figure 8:
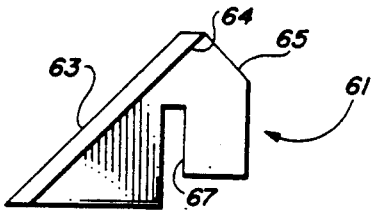
FIG. 8 is an end view of the attachment shown in FIG. 5.

When using the accessory 11 to alternatively cut either square or 45° angle cuts, the second slot 23 is aligned with a guide groove 551 of a table saw working surface 552 shown in FIG. 1. Next, the second guide rail 25 is moved into an active position below the bottom surface 27 as shown in FIGS. 3 and 4 and into the groove 551. During this movement of the guide rail 25, a slot in the bottom mid-portion thereof receives a portion 40 of the plate 13 that supports the actuator 32. To provide intimate contact between the lower surface 27 of the plate 13 and the table working surface 46, the first rail 24 is first moved, as shown in FIGS. 3 and 4 into an inactive position above the lower surface 27 by the actuator 31 in a manner described below. Relative vertical movement between the rails 24 and 25 is accommodated by an upwardly directed slot 20 in the second rail 25 and an aligned downwardly directed slot 30 in the first rail 24. A workpiece (not shown) is then held firmly against either the second guide surface 36 or the third guide surface 38 and moved through a circular saw blade 56 as shown by dashed lines in FIG. 2 to produce a desired cut. If a square cut is desired, the workpiece is held against the second guide surface 36 and if a 45° angle cut is desired, the workpiece is held against the third guide surface 38.

Assuming that only 45° cuts are desired, the first rail 24 can be employed to produce cuts from either the front or back of the saw 57. Before switching from the second rail 25 to the first rail 24, the second rail 25 is moved into an inactive position by the actuator 32. That is accomplished by pulling on the knob 45 to raise the second rail 25 above the lower surface 27 of the plate 13 against the bias of the spring 50. After obtaining the inactive position for the second rail 25, the knob 45 is rotated to move the attached latch plate 49 into the latch slots 51, 52 in the legs 41, 42 thereby preventing movement of the rail 25 back into its active position. An opposite operation is performed with the actuator 31 allowing its spring to force the first rail 24 into its active position below the lower surface 27 of the plate 13. After insertion of the first rail 24 into the guide groove 55, workpieces can be alternatively held against either the first guide surface 35 or the second guide surface 36 to produce, respectively, 45° angle cuts from either the front or back of the circular saw 57.

The accessory 11 also can be adapted for use with a dado blade. When utilizing the first rail 24, the spacer block 54 is removed from the first auxilliary surface 37. Removal of the spacer block 54 provides an area adjacent to the first alignment surface 37 for accommodating a dado blade or molding cutter. Similarly, when working with the second rail 25 the spacer block 58 is removed from the second alignment surface 39. Removal of the spacer block 58 again provides a space parallel to the second alignment surface 39 for accommodating a dado blade or molding cutter.

In conjuction with the attachment 61 shown in FIGS. 5–8 the accessory 11 can be used also to produce compound 45° angle cuts. The attachment 61 includes a plate 62 providing a front attachment guide surface 63 in the form of a trapezoid. Extending from a rear surface 64 of the plate 62 are a plurality of spaced apart brackets 65. A slot 67 oriented at an angle of 45° with respect to the guide surface 63 is formed in each of the brackets 65.

Figure 2:
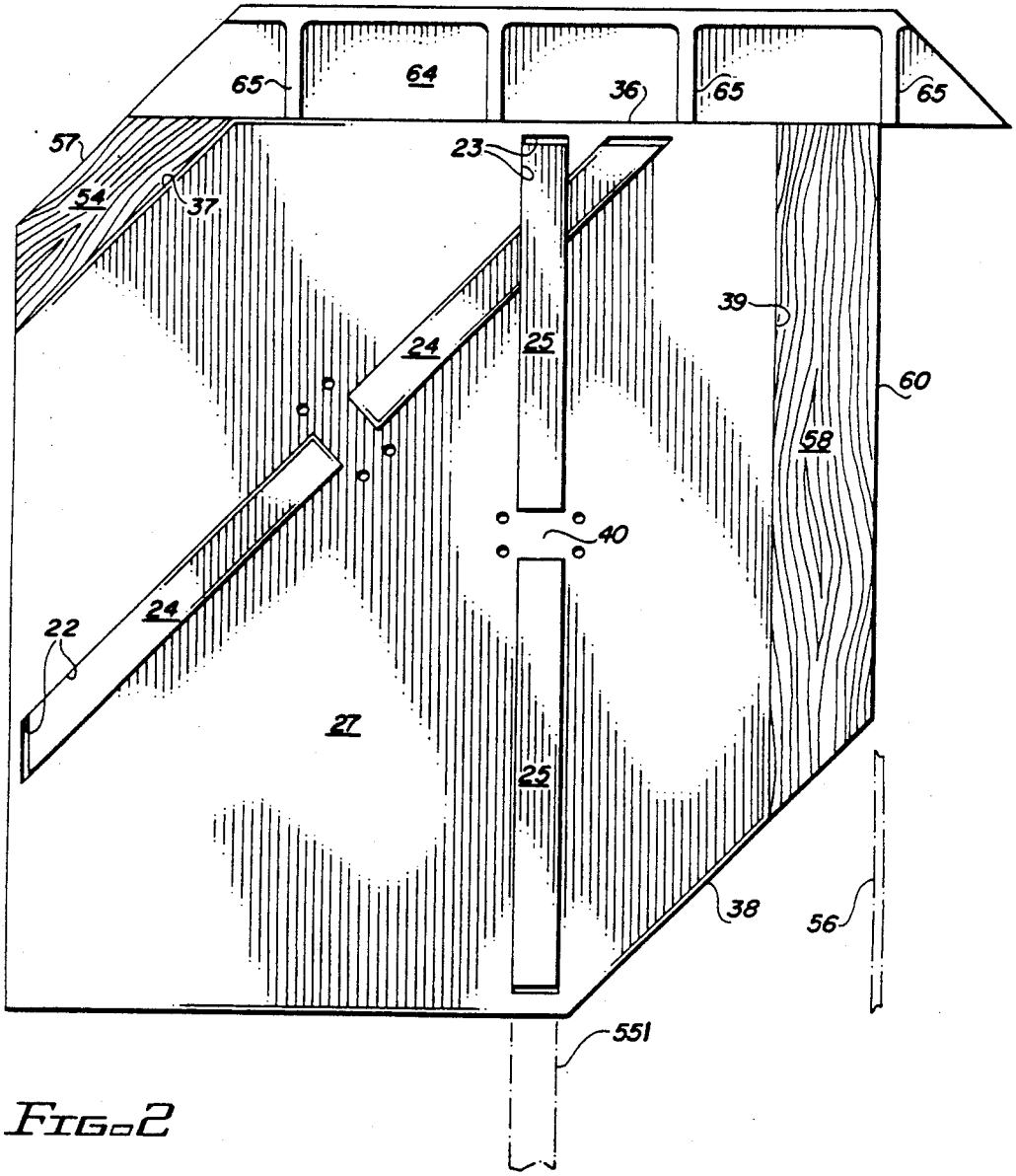
FIG. 2 is a bottom view of the accessory shown in FIG. 1 and including an attachment used therewith.

When attached to the wall 15 of the accessory 11 as shown by dashed lines in FIG. 2, the attachment guide surface 63 assumes a position parallel to the first guide surface 35 and sloping downwardly therefrom at an angle of 45°. During assembly of the attachment 61, the slots 67 engage appropriately spaced apart slots 68 in the upper edge of the wall 15 to establish the desired orientation for the attachment guide surface 63. A workpiece held firmly against the attachment surface 63 can then be moved through the blade 57 to provide a compound 45° angle cut. The attachment 61 can be attached similarly to the wall 17 by engaging the slots 67 in the brackets 65 with appropriately spaced slots 69 in the upper edge of the wall 17 to superimpose the attachment surface 63 on the second guide surface 36.

Obviously, many modifications and variations of the present invention are possible in light of the above teachings. For example, if desired, the actuators 31, 32 can be modified to bias the first and second rails 24, 25 into their inactive positions and operable to affect movement and latching thereof into their active positions. In addition, the first and second rails 24, 25 can be replaced with other elongated track systems suitable for reception by grooves in table saw work surfaces and for guiding movement of the accessory therein. It is to be understood, therefore, that the invention can be practiced otherwise than as specifically described.

What is claimed is:

1. An accessory for use with a table saw having a generally horizontal surface defining at least one rectalinear groove and a circular saw blade projecting through the horizontal surface and parallel to the groove comprising;

a plate means having lower and upper surfaces, said lower surface adapted for sliding movement on the horizontal surface;

a first rectalinear rail means supported by said plate means and projecting in an active position below said lower surface and adapted to ride in the groove, and guide movement of said plate means parallel to the groove, said first rail means being further adapted for movement into an inactive position above said lower surface;

a second rectalinear rail means supported by said plate means and adapted for movement between an active position below said lower surface and an inactive position above said lower surface, said second rail means in said active position adapted to ride in the groove and guide movement of said plate means parallel to the groove, said second rail means being oriented at an angle of 45° to said first rail means;

a first fence means defining a first rectalinear guide surface oriented at an angle of 45° to said first rail means; and a second fence means defining a second rectalinear guide surface oriented at an angle of 45° to said first rail means, and perpendicular to said second rail means.

2. An accessory according to claim 1 including a first actuator means coupled to said first rail means and operable to produce movement thereof between said active and inactive positions; and a second actuator means coupled to said second rail means and operable to produce movement thereof between said active and inactive positions.

3. An accessory according to claim 2 including a third fence means defining a third rectalinear guide surface oriented at an angle of 45° to said second rail means.

4. An accessory according to claim 3 including auxilliary fence means defining a first auxilliary surface joining said first and second guide surfaces and oriented at angles of 45° with respect thereto, and a second auxilliary surface joining said third guide surface and said second guide surface and oriented perpendicular to said second guide surface and wherein said first and second auxilliary surfaces straddle said first and second rail means.

5. An accessory according to claim 4 wherein said plate means and said first, second and third fence means are formed as a composite unit.

6. An accessory according to claim 5 wherein said first and second rail means comprise continuous tracks having a rectangular cross-section corresponding to the cross section of the groove.

7. An accessory according to claim 3 wherein said first actuator means comprises first bias means biasing said first rail means in one of said active or inactive positions, and first latch means operable to latch said first rail means in the other of said positions; and said second actuator means comprises second bias means biasing said second rail means in one of said active or inactive positions, and said latch means operable to latch said second rail means in the other of said positions.

8. An accessory according to claim 6 wherein said first and second bias means comprise first and second spring members exerting a force between, respectively, said first and second rail means and said plate means; and said first and second latch means comprise first and second latch members movable into positions to latch, respectively, said first and second rail means to said plate means.

9. An accessory according to claim 3 wherein said first, second, and third fence means comprise, respectively, first, second and third walls extending normally to said upper surface of said plate means.

10. An accessory according to claim 4 including attachment means adapted for attachment to said accessory and defining therewith an attachment guide surface extending parallel to one of said first or second guide surfaces and inclined at an angle of 45° thereto.

11. An accessory according to claim 10 wherein said first, second, and third fence means comprise, respectively, first, second and third walls extending normally to said supper surface of said plate means.

12. An accessory according to claim 11 wherein said attachment means comprises a plurality of brackets extending rearwardly from said attachment guide surface, each of said brackets having an attachment slot; and at least one of said first, second or third walls has a plurality of receiving slots each adapted to receive one of said attachment slots.

13. An accessory according to claim 12 wherein each of said first and second walls has said receiving slots.

14. An accessory according to claim 4 including wall means defining first and second alignment surfaces parallel, respectively, to said first and second auxilliary surfaces; and wherein said auxilliary fence means comprises removable spacer blocks forming said first and second auxilliary surfaces and removable to expose said first and second alignment surfaces.

15. An accessory according to claim 10 wherein said plate means and said first, second, and third fence means and said first and second alignment surfaces are formed as a composite unit.

16. An accessory according to claim 15 wherein said first and second rail means comprise continuous tracks having a rectangular cross-section corresponding to the cross section of the groove.

17. An accessory according to claim 16 wherein said first actuator means comprises first bias means biasing said first rail means in one of said active or inactive positions, and first latch means operable to latch said first rail means in the other of said positions; and said second actuator means comprises second bias means biasing said second rail means in one of said active or inactive positions, and second latch means operable to latch said second rail means in the other of said positions.

18. An accessory according to claim 17 wherein said first and second bias means comprise first and second spring members exerting a force between, respectively, said first and second rail means and said plate means; and said first and second latch means comprise first and second latch members movable into positions to latch, respectively, said first and second rail means to said plate means.

19. An accessory according to claim 18 wherein said first, second and third fence means and said first and second alignment surfaces comprise walls extending normally to said upper surface of said plate means.

20. An accessory according to claim 3 wherein said plate means defines first and second elongated slots that retain, respectively, said first and second rail means and accommodate movement thereof between said active and inactive positions.

* * * * *